US008522743B2

(12) United States Patent
Ohmori et al.

(10) Patent No.: US 8,522,743 B2
(45) Date of Patent: Sep. 3, 2013

(54) MULTI-CYLINDER INTERNAL COMBUSTION ENGINE

(75) Inventors: Kenichi Ohmori, Saitama (JP); Akifumi Nomura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 707 days.

(21) Appl. No.: 12/650,819

(22) Filed: Dec. 31, 2009

(65) Prior Publication Data

US 2010/0192900 A1 Aug. 5, 2010

(30) Foreign Application Priority Data

Jan. 30, 2009 (JP) ..... 2009-019223

(51) Int. Cl.
*F01M 1/02* (2006.01)
*F02B 77/00* (2006.01)

(52) U.S. Cl.
USPC ..... 123/196 R; 123/195 C; 123/195 R

(58) Field of Classification Search
USPC ..... 123/195 R, 196 R, 52.1, 195 H, 123/197.1, 196 AB, 196 M, 196 S, 563, 184.22, 123/196 B, 195 C; 192/3.62; 184/6.5, 106
See application file for complete search history.

(56) References Cited

U.S. PATENT DOCUMENTS 7,645,175 B2 * 1/2010 Miyata ..... 440/88 L
7,827,955 B2 * 11/2010 Matsuda et al. ..... 123/195 AC
2003/0070661 A1 * 4/2003 Yasui ..... 123/572

FOREIGN PATENT DOCUMENTS

JP 2006-70795 A 3/2006

* cited by examiner

*Primary Examiner* — Noah Kamen
(74) *Attorney, Agent, or Firm* — Birch, Stewart, Kolasch & Birch, LLP

(57) ABSTRACT

A communicating passage for discharging oil and recovering the oil in an oil pan in a multi-cylinder internal combustion engine wherein the communicating passage enables internal spaces of a plurality of crank chambers corresponding to a plurality of cylinders to communicate is provided to a crankcase. An opening of a drain for discharging oil inside the communicating passage is provided. In addition, the drain for discharging the oil via the opening is provided. The drain is formed to discharge the oil on the side of the oil pan provided to the crankcase.

10 Claims, 7 Drawing Sheets

MULTI-CYLINDER INTERNAL COMBUSTION ENGINE

CROSS-REFERENCE TO RELATED APPLICATIONS

The present application claims priority under 35 USC 119 to Japanese Patent Application No. 2009-019223 filed on Jan. 30, 2009 the entire contents of which are hereby incorporated by reference.

BACKGROUND OF THE INVENTION

1. Field of the Invention

The present invention relates to a multi-cylinder internal combustion engine provided with a communicating passage for permitting a plurality of crank chambers communicate with each other.

2. Description of Background Art

A communicating passage for permitting adjacent cylinders to communicate outside a crankcase is provided to a skirt on the downside of a cylinder block. See, for example, JP-A No. 2006-70795 (FIGS. 1, 3). In such background art, it is a problem how oil splashed up by a crank weight should be discharged when the oil enters the communicating passage.

SUMMARY AND OBJECTS OF THE INVENTION

According to an embodiment of the present invention, a means is provided for discharging oil that enters a communicating passage for making a plurality of crank chambers communicate and recovering the oil in an oil pan.

According to an embodiment of the present invention, a multi-cylinder internal combustion engine includes a communicating passage that permits internal spaces of a plurality of crank chambers corresponding to the plurality of cylinders to communicate. The communicating passage is provided relative to a crankcase wherein an opening of a drain for discharging oil inside the communicating passage is provided. The drain is provided and the oil is discharged via the drain from the opening of the drain.

According to an embodiment of the present invention, the drain is formed to discharge oil on the side of an oil pan provided to the crankcase.

According to an embodiment of the present invention, the communicating passage is configured by fixing a cover in the shape of a bowl that encloses a communicating hole provided to the crankcase so as to make the crank chamber and the communicating passage communicate to the crankcase. The bottom of the cover is inclined downwardly toward the opening of the drain.

According to an embodiment of the present invention, a return passage of oil that lubricates a cylinder head or a valve system is connected to the communicating passage.

According to an embodiment of the present invention, the multi-cylinder internal combustion engine is a parallel engine mounted in a motorcycle with its crankshaft located in a direction of vehicle width and the opening of the drain is arranged near to the outside in the direction of vehicle width.

According to an embodiment of the present invention, an inlet via which return oil via the oil return passage enters the communicating passage is set near to the inside in the direction of vehicle width off the opening of the drain in the direction of vehicle width.

According to an embodiment of the present invention, as the opening of the drain and the drain for discharging oil inside the communicating passage are provided, oil that enters the communicating passage can be discharged.

According to an embodiment of the present invention, as the drain is formed to discharge oil on the side of the oil pan provided to the crankcase, entering oil can be recovered in the oil pan.

According to an embodiment of the present invention, as the communicating passage is configured by fixing the cover in the shape of a bowl that encloses the communicating hole provided to the crankcase so as to make the crank chamber and the communicating passage communicate to the crankcase and the bottom of the cover is inclined downward toward the opening of the drain, oil splashed inside the cover can be gathered into the opening of the drain and the efficiency of recovery can be enhanced.

According to an embodiment of the present invention, as the return passage of oil that lubricates the cylinder head and the valve system is connected to the communicating passage, the oil can be recovered in the oil pan together.

According to an embodiment of the present invention, as the opening of the drain is arranged near to the outside in the direction of vehicle width, oil which is apt to accumulate outside in the direction of the vehicle width by centrifugal force as the motorcycle is laterally banked can be efficiently recovered.

According to an embodiment of the present invention, as the inlet for return oil is set near to the inside in the direction of the vehicle width off the opening of the drain in the direction of the vehicle width, oil taken in from the inside is made to flow toward the opening located outside of the drain by centrifugal force and therefore, the oil can be prevented from accumulating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
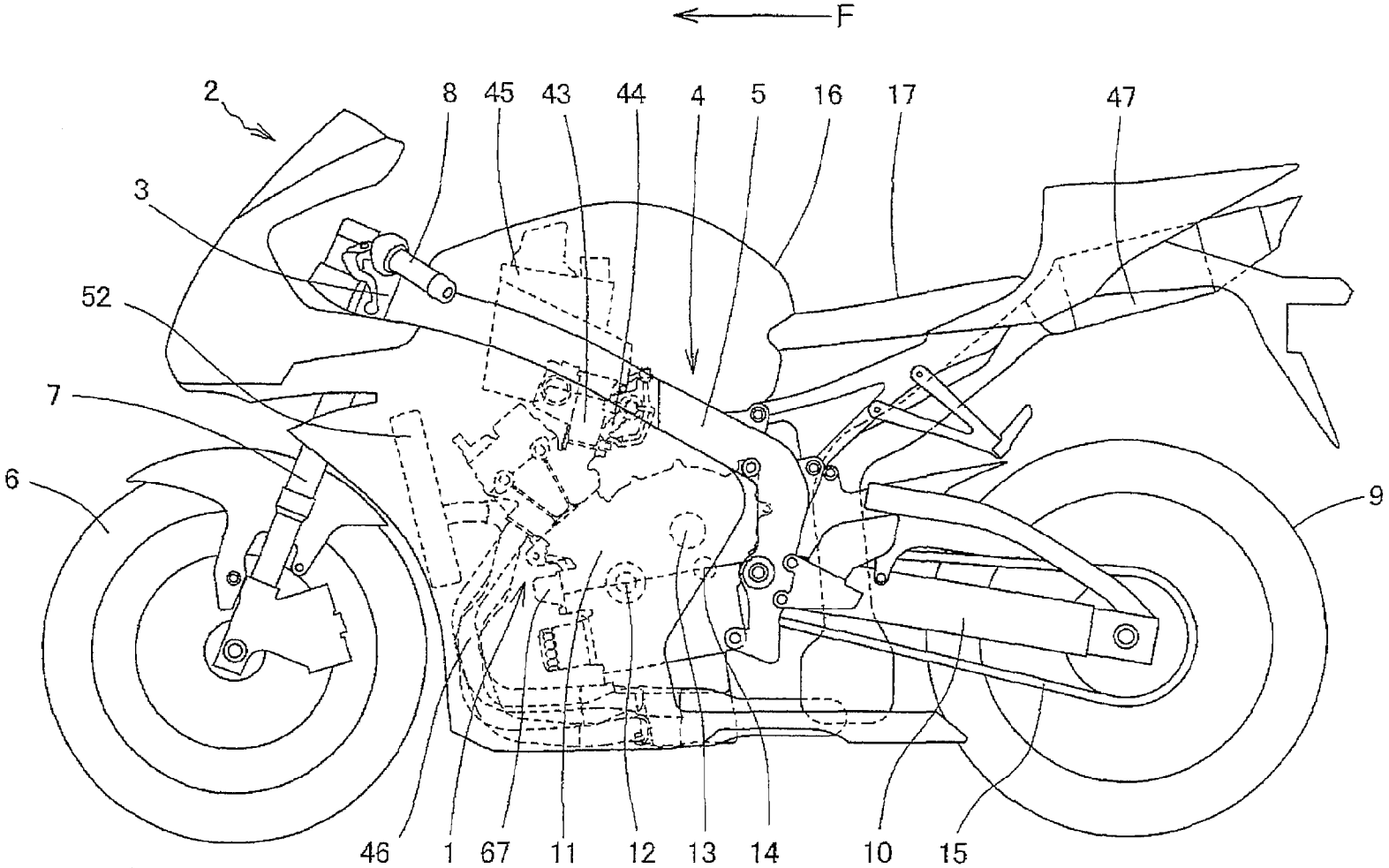
FIG. 1 is a side view showing a motorcycle provided with a four-cylinder internal combustion engine equivalent to one embodiment of the present invention.

FIG. 1 is a side view showing a motorcycle 2 provided with an internal combustion engine 1 equivalent to one embodiment of the present invention. An arrow F in FIG. 1 indicates a forward direction. A head pipe 3 is provided to a front end of a vehicle and a body frame 4 is provided with a pair of main frames 5 extending rearwardly with the main frames laterally separated from the head pipe 3 and inclined rearwardly and downwardly. A front fork 7 that supports a front wheel 6 is steerably supported by the head pipe 3 and a steering handlebar 8 is coupled to an upper part of the front fork 7. A rear fork 10 that supports a rear wheel 9 is vertically swingably supported via suspending means by the body frame 4. The internal combustion engine 1 mounted inside the body frame 4 is the four-cylinder internal combustion engine 1 where cylinders are arranged in a direction perpendicular to a traveling direction of the vehicle. A crankcase 11 of the internal combustion engine 1 is the crankcase 11 with which a transmission is integrated and includes a crankshaft 12, a main shaft 13 and a countershaft 14 of the constant-mesh type transmission. An output shaft of the internal combustion engine 1 is the countershaft 14 of the transmission and power is transmitted to the rear wheel 9 via a driving sprocket (not shown) provided to a part protruding outside the crankcase 11 at a left end of the countershaft 14 and a chain for driving the rear wheel 15. A fuel tank 16 is provided to an upper part of the body frame 4 and a tandem seat 17 is provided to the rear.

Figure 2:
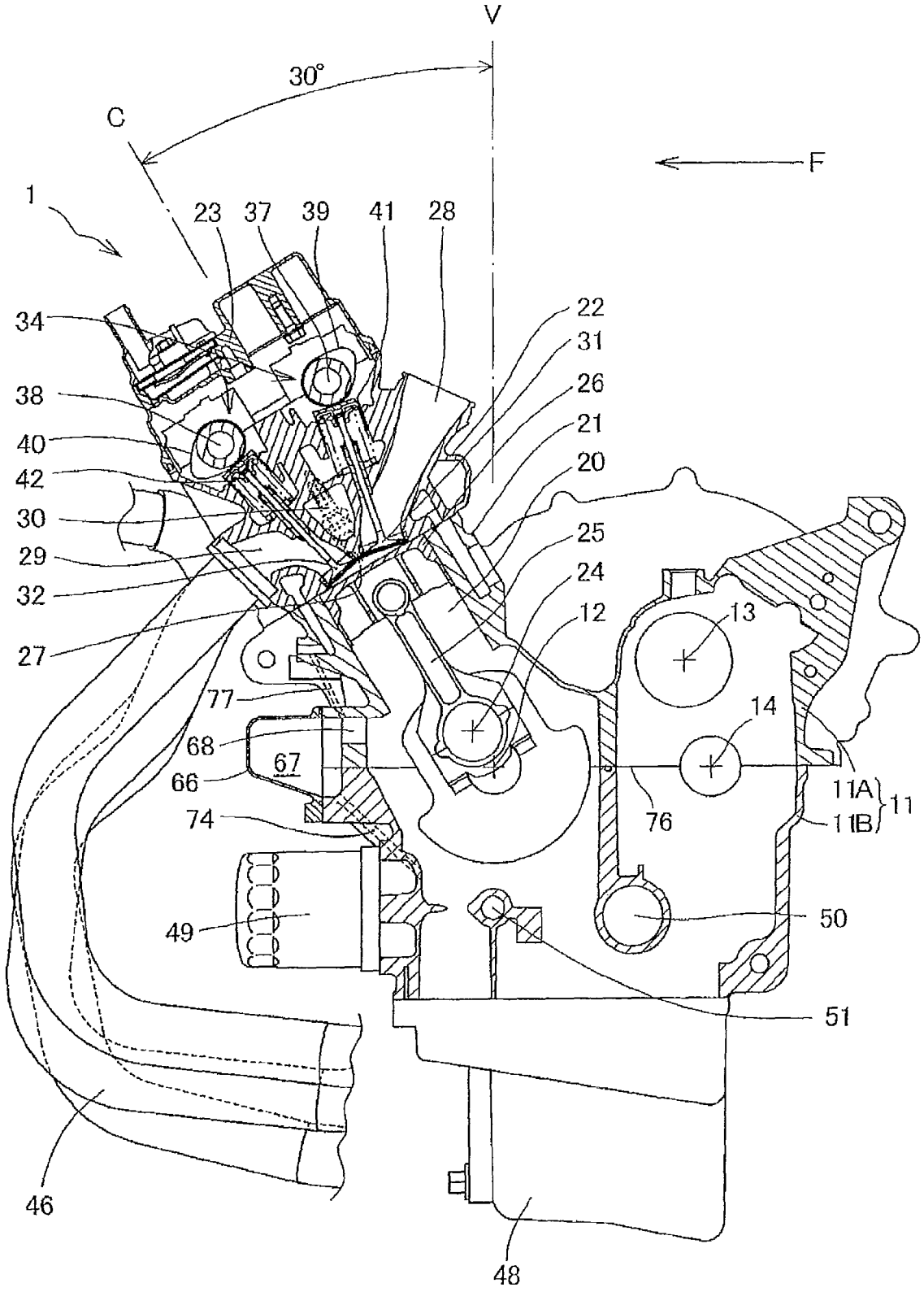
FIG. 2 shows a longitudinal section of the internal combustion engine viewed from the left side.

FIG. 2 shows a longitudinal section viewed from the left of the internal combustion engine 1. The crankcase 11 is vertically divided in two and is configured by an upper crankcase 11A and a lower crankcase 11B. A cylinder block 21 provided with four cylinders 20 is integrated with the upper crankcase 11A. A cylinder head 22 and a cylinder head cover 23 are connected to a top face of the cylinder block 21 in order. The crankshaft 12 and the countershaft 14 are held on a joined plane 76 of the upper crankcase 11A and the lower crankcase 11B in a direction of the vehicle width. The main shaft 13 is held in the direction of the vehicle width in the upper crankcase 11A.

A piston 26 is connected to a crankpin 24 of the crankshaft 12 via a connecting rod 25 and is slid in the cylinder 20. A combustion changer 27 is formed between each piston 26 and the cylinder head 22. An intake port 28 and an exhaust port 29 respectively communicating with each combustion chamber 27 are provided in the cylinder head 22, the intake port 28 connects with the combustion chamber 27 via a pair of its inside openings, and the exhaust port 29 also connects with the combustion chamber 27 via a pair of its inside openings.

An ignition plug 30 is provided in the center of the individual combustion chamber 27. A pair of intake valves 31 and a pair of exhaust valves 32 are provided around the ignition plug 30. These valves are driven by a valve gear 34, and open and close the respective inside openings of the intake port and the respective inside openings of the exhaust port. The valve gear 34 is provided with an intake camshaft 37, an exhaust camshaft 38, an intake cam 39 and an exhaust cam 40, presses an intake valve lifter 41 and an exhaust valve lifter 42 respectively provided to each valve, and opens and closes the intake valve 31 and the exhaust valve 32 at a predetermined time according to a rotational position of the crankshaft 12.

An intake system is connected to an outside opening of the intake port 28. The intake system includes a throttle valve 43, a fuel injection system 44 and an air cleaner 45 (respectively shown in FIG. 1). An exhaust pipe 46 is connected to each exhaust port 29, each exhaust pipe is united in the rear through a lower part of a vehicle body, and the united exhaust pipe is connected to a muffler 47 in the rear of the vehicle (FIG. 1). A radiator 52 is provided in front of the cylinder block 21 (FIG. 1).

An oil pan 48 is provided to a lower part of the lower crankcase 11B and an oil filter 49 is provided in front of the lower crankcase 11B. An oil pump 50 and a main gallery 51 are provided in the lower crankcase 11B. The oil pump 50 sucks oil reserved in the oil pan 48 and supplies it to lubricating locations via the oil filter 49, the main gallery 51 and others.

Figure 3:
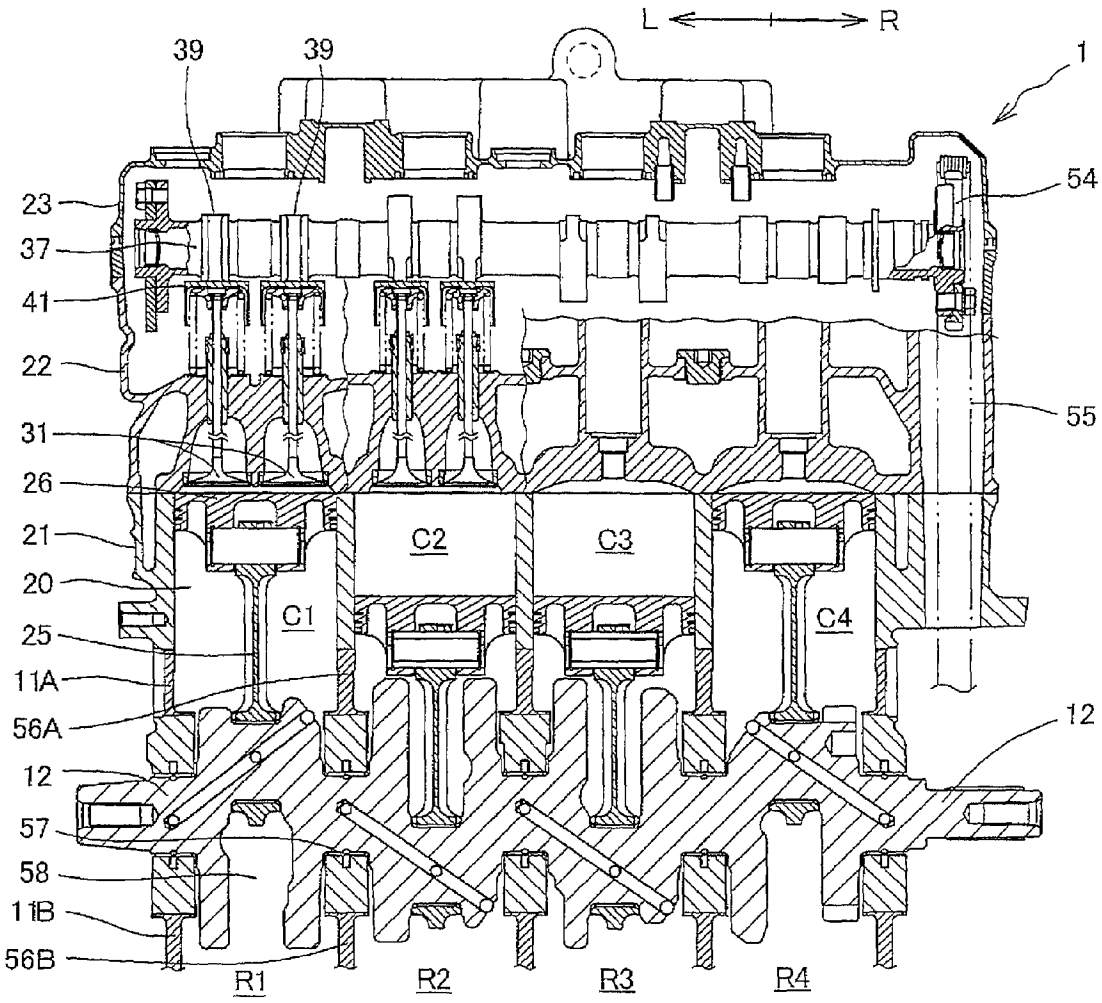
FIG. 3 shows a cross section passing an intake valve of an upper part of the internal combustion engine viewed from the rear side.

FIG. 3 shows a cross section passing the intake camshaft 37 and viewed from the rear of an upper part of the internal combustion engine 1. Arrows L, R in FIG. 3 indicate a leftward direction and a rightward direction and correspond to the left and the right of the vehicle when the internal combustion engine 1 is mounted in the vehicle. The lower crankcase 11B, the upper crankcase 11A, the cylinder block 21, the cylinder head 22 and the cylinder head cover 23 are connected in order from a lower part of the drawing. The four cylinders 20 are laterally arranged in parallel.

The intake camshaft 37 is supported between the cylinder head 22 and the cylinder head cover 23. An intake camshaft driven sprocket 54 is provided at a right end of the intake camshaft 37 and is driven by the crankshaft 12 via a camshaft driving chain 55. The two intake valves 31 are provided to one cylinder 20 and the intake valve lifter 41 is provided to an upper part of each intake valve 31. The intake cam 39 provided to the intake camshaft 37 abuts on the top of the intake valve lifter 41. Though the followings are not shown in FIG. 3, the exhaust camshaft 38, the exhaust cam 40, the exhaust valve 32, the exhaust valve lifter 42, an exhaust camshaft driven sprocket (not shown) and others are also similarly provided.

The four cylinders 20 of the internal combustion engine 1 are named the first cylinder C1, the second cylinder C2, the third cylinder C3 and the fourth cylinder C4 from the left side. The crankshaft 12 is in a shape shown in FIG. 3 and an explosion stroke is repeated with phase difference at an equal interval of 180 degrees as a crank angle in the order of the first cylinder C1, the third cylinder C3, the fourth cylinder C4, the second cylinder C2 and the first cylinder C1.

In the crankcase 11 around the crankshaft 12, an upper bulkhead 56A and a lower bulkhead 56B extend from respective inside faces of the upper crankcase 11A and the lower crankcase 11B are provided between corresponding cylinders, a bearing 57 is formed on a joining surface of each bulkhead, and the crankshaft 12 is rotatably supported. The piston 26 is connected to the crankshaft 12 via the connecting rod 25. The crankcase 11 is partitioned at every cylinder by the upper bulkhead 56A and the lower bulkhead 56B and plural crank chambers 58 are formed. The crank chambers 58 are named the first crank chamber R1, the second crank chamber R2, the third crank chamber R3 and the fourth crank chamber R4 from the left side. As each crank chamber 58 is located on the downside of the piston 26, the volume of each crank chamber 58 increases or decreases according to the displacement of the piston 26.

Figure 4:
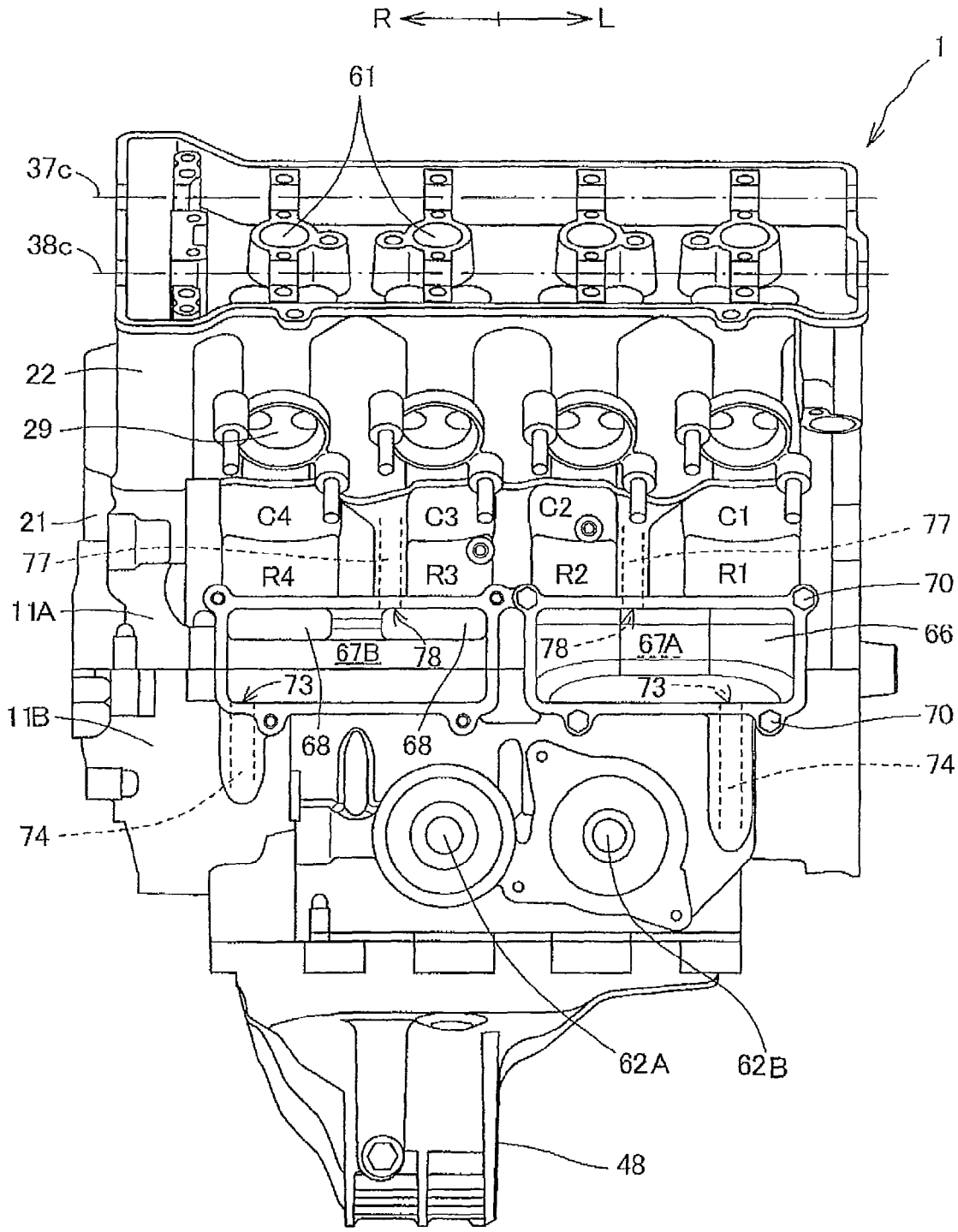
FIG. 4 is a front view showing the appearance of the internal combustion engine.
Figure 5:
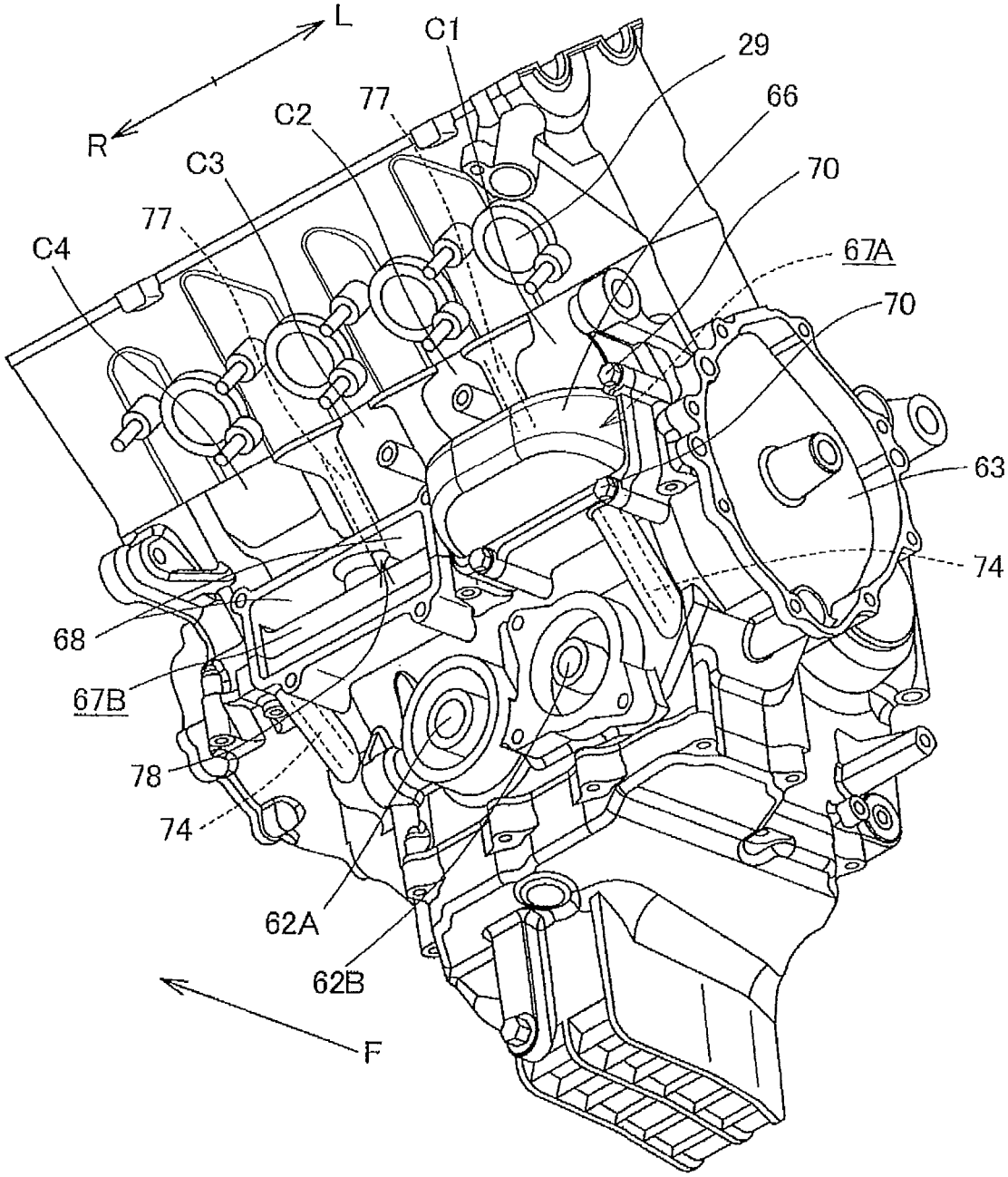
FIG. 5 is a perspective view showing the internal combustion engine.

FIG. 4 is a front view showing the appearance of the internal combustion engine 1 and FIG. 5 is a perspective view showing the appearance of the internal combustion engine 1. As FIGS. 4 and 5 show the internal combustion engine 1 viewed from its front side and the downside of the front side, the cylinders are arranged in the order of the first cylinder C1, the second cylinder C2, the third cylinder C3 and the fourth cylinder C4 from respective right sides in FIGS. 4 and 5. The crank chambers are similarly arranged in the order of the first crank chamber R1, the second crank chamber R2, the third crank chamber R3 and the fourth crank chamber R4 from the respective right sides in FIGS. 4 and 5. In these drawings, the cylinder head cover 23 is omitted. An ignition plug insertion hole 61 is provided to a top face of the cylinder head 22. FIG. 4 also shows a center line 37*c* of the intake camshaft 37 and a center line 38*c* of the exhaust camshaft 38. An outside opening of the exhaust port 29 is provided to the front of the cylinder head 22. The exhaust pipe 46 (FIG. 2) is attached to this part. An oil filter attachment 62A and an attachment 62B of a water-cooled oil cooler (not shown) are provided to the front of the lower crankcase 11B. The oil pan 48 is provided in a lower part of the lower crankcase 11B. An alternator attachment 63 (FIG. 5) is provided to a left projection of the crankshaft 12 between the upper and lower crankcases 11A, 11B.

Phase difference in a position of each piston between the first crank chamber R1 and the second crank chamber R2 is 180 degrees and when one crank chamber 58 is pressurized, the other crank chamber 58 is decompressed. The relation between the third crank chamber R3 and the fourth crank chamber R4 is also similar with the increase and the decrease of pressure function as resistance to the displacement of the piston 26 and power is lost.

As means for dissolving the resistance to the displacement of the piston caused by the increase and the decrease of pressure, a communicating passage 67 covered with a cover 66 is provided between the first crank chamber R1 and the second crank chamber R2 and between the third crank chamber R3 and the fourth crank chamber R4 as shown in FIGS. 4 and 5. FIGS. 4 and 5 show the first communicating passage 67A covered with the cover 66 on the respective fronts of the first cylinder C1 and the second cylinder C2 and the second communicating passage 67B in a state in which the cover 66 is removed and the second communicating passage is exposed on the respective fronts of the third cylinder C3 and the fourth cylinder C4. In the second communicating passage 67B, a communicating hole 68 that communicates with the third crank chamber R3 and a communicating hole 68 that communicates with the fourth crank chamber R4 are shown. Though the followings are not shown in the drawings because they are covered with the cover 66, the similar communicating holes 68 that communicate with the first communicating passage 67A are also provided to the first crank chamber R1 and the second crank chamber R2. The longitudinal sections of the cover 66, the communicating passage 67 and the communicating hole 68 are shown in FIG. 2.

As owing to the communicating passage 67 and the communicating hole 68, increased pressure in one crank chamber out of the first crank chamber R1 and the second crank chamber R2 is released into the other decompressed crank chamber and increased pressure in one crank chamber out of the third crank chamber R3 and the fourth crank chamber R4 is released into the other decompressed crank chamber, resistance to the displacement of the piston 26 caused by the increase and the decrease of pressure in the crank chamber, that is, power loss is dissolved.

Figure 6:
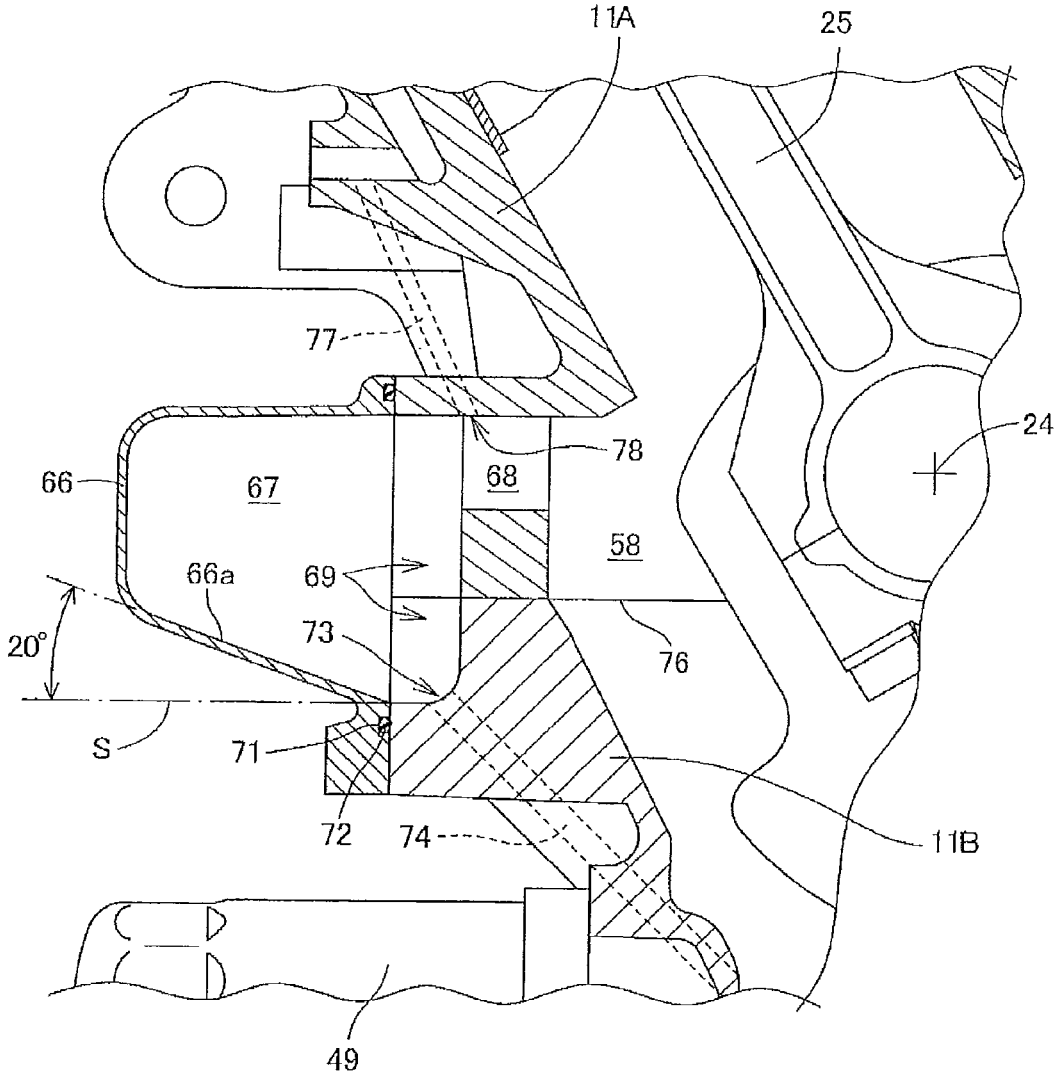
FIG. 6 is an enlarged view showing a longitudinal section of a communicating passage.

FIG. 6 is an enlarged view showing the longitudinal section of the vicinity of the communicating passage 67. The communicating passage 67 is provided across the joined plane 76 of the upper crankcase 11A and the lower crankcase 11B as shown in FIG. 6. The communicating hole 68 is provided to the upper crankcase 11A, however, the communicating hole 68 may also be provided to the lower crankcase 11B. As the communicating passage 67 can be laid with arrangement space shared by arranging the communicating passage across the upper and lower crankcases 11A, 11B, compared with a case that the communicating passage is arranged only on either side, the respective height of the upper and lower crankcases 11A, 11B can be reduced and the internal combustion engine can be miniaturized.

The first and second communicating passages 67A, 67B are both formed in the shape of a bowl to cover the communicating hole 68 in a front view, and space for the communicating passage 67 is configured by an inside face of the cover 66 and the front of the crankcase 11. As the communicating passage 67 is configured utilizing a part of the crankcase 11 by attaching the cover 66 in the shape of a bowl covering the communicating hole 68 to the front of the crankcase 11, the communicating passage can be configured by the simple member.

A concave portion 69 is made by hollowing the fronts of the upper and lower crankcases 11A, 11B respectively overlapped with the cover 66 in the front view (FIG. 6). Thus, the space for the communicating passage 67 can be extended by only hollowing the side of the crankcase 11 without increasing the size and the depth of the cover 66 and the large-sizing of the outline of the communicating passage 67 can be inhibited. The concave portion 69 may be also provided to the front of either of the upper or lower crankcase 11A, 11B.

The cover 66 is fixed to the upper and lower crankcases 11A, 11B via a bolt 70 (FIGS. 4 and 5) in upper and lower positions. The strength of the joining of the upper and lower crankcases 11A, 11B can be increased by fixing the cover 66 vertically across the crankcase 11.

As shown in FIG. 6, to prevent oil from leaking from the communicating passage 67, a groove 71 is formed on a face on which the cover 66 abuts on the crankcase 11, a sealing member 72 is arranged there, and the above-mentioned face on the side of the upper and lower crankcases 11A, 11B is flatly formed. The groove 71 can be easily formed by forming the sealing groove 71 on the side of the cover 66, compared with a case that the sealing groove is formed across the upper and lower crankcases on the side of the crankcase and the shape can be further easily adjusted.

Deposit is apt to accumulate in the communicating passage 67. This means that the mixture cooled and liquidized of combusted gas that leaks from the cylinder 20 and misty lubricating oil and oil stirred up by a crank weight is entered into the communication passage. To discharge the deposit, an opening 73 of a drain for discharging oil accumulated inside the communicating passage 67 is provided as shown in FIGS. 4 and 6 and the oil is discharged through a drain 74 (see FIGS. 2 to 6) from the opening 73.

The drain 74 is formed to discharge the oil into the oil pan 48 (FIG. 2) provided to the lower crankcase 11B. Thus, the oil accumulated in the communicating passage 67 is discharged and can be recovered in the oil pan 48.

The communicating passage 67 is configured by fixing the cover 66 in the shape of a bowl surrounding the communicating hole 68 provided to the crankcase 11 to the crankcase 11 and as shown in FIG. 6, the bottom 66*a* of the cover 66 is inclined downward toward the opening 73 of the drain. Thus, oil splashed inside the cover 66 can be gathered to the opening 73 of the drain and the efficiency of recovery can be enhanced. The bottom 66*a* of the cover 66 is inclined rearwardly and downwardly at an angle of 20 degrees with a plane S parallel to the joined plane 76 of the upper and lower crankcases 11A, 11B. When the internal combustion engine 1 is mounted in the vehicle, the joined plane 76 is inclined forward and downward by 10 degrees. Accordingly, as the bottom of the cover 66 is kept inclined rearwardly and downward at the angle of 10 degrees with a horizontal plane, the oil can be gathered into the opening 73 of the drain.

As shown in FIG. 4, the opening 73 of the drain is arranged near to the outside in the direction of vehicle width of each communicating passage 67. Thus, the deposit is apt to accumulate outside in the direction of vehicle width by centrifugal force as the motorcycle 2 is sometimes laterally banked and the oil can be efficiently recovered by providing the opening 73 of the drain near to the outside in the direction of vehicle width.

Oil that lubricates the cylinder head 22, the valve gear 34 and others is returned into the communicating passage 67 via a valve system oil return passage 77 provided to the upper crankcase 11A and a return oil inlet 78 provided to the communicating passage 67 as shown in FIGS. 4 to 6. The oil returned as described above is recovered in the oil pan 48 through the opening 73 of the drain and the drain 74 together with the above-mentioned deposit.

The return oil inlet 78 is set off the opening 73 inside in the direction of vehicle width (FIGS. 4 and 5). Thus, oil taken from the inside is made to flow toward the outside opening 73 by centrifugal force and the oil can be prevented from accumulating, compared with a case wherein the return oil inlet 78 and the opening 73 are connected outside without setting the return oil inlet and the opening off.

As shown in FIG. 2, the internal combustion engine 1 is provided with the exhaust pipe 46 extending rearwardly of the vehicle after the exhaust pipe is curved from the cylinder head 22 in front and on the downside of the cylinder block 21. The communicating passage 67 is arranged in an area enclosed by the front of the crankcase 11 and the exhaust pipes 46. Accordingly, the communicating passage 67 is effectively arranged effectively utilizing vacant space, inhibiting interference with the exhaust pipe 46.

A center line C of the cylinder 20 shown in FIG. 2 is inclined forward at an angle of thirty degrees with a vertical line V perpendicular to the joined plane 76 of the upper and lower crankcases 11A, 11B. However, as the joined plane 76 of the crankcase 11 is inclined forward and downward by 10 degrees when the internal combustion engine 1 is mounted in the vehicle, the cylinder 20 is inclined forward at an angle of 40 degrees with a perpendicular line to the ground when the engine is mounted in the vehicle and the upside of the communicating passage 67 is fully covered. Thus, the upside of the communicating passage 67 is safely protected in the area enclosed by the cylinder block 21, the front of the crankcase 11 and the exhaust pipes 46, avoiding the interference with the exhaust pipes 46 (FIG. 1).

As shown in FIG. 2, the oil filter 49 is arranged on the front of the lower crankcase 11B located on the downside of the communicating passage 67. The oil filter 49 is attached to the oil filter attachment 62A shown in FIGS. 4 and 5. The water-cooled oil cooler (not shown) is attached to the water-cooled oil cooler attachment 62B. The communicating passage 67 is arranged on the upside of the oil filter 49 and the oil cooler effectively utilizing the vacant space, preventing interference with the oil filter and the oil cooler.

Figure 7:
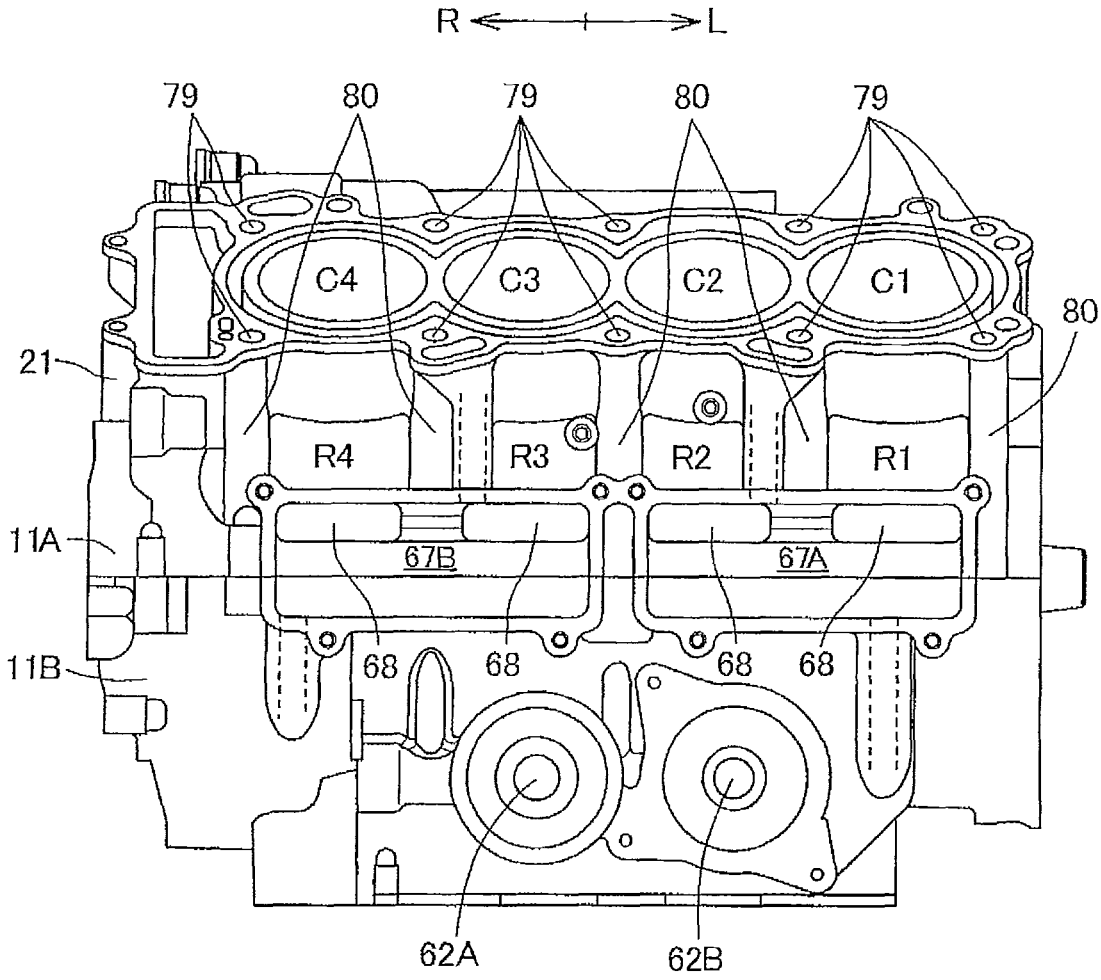
FIG. 7 is a front view showing a crankcase and a cylinder block.

FIG. 7 is a front view showing the crankcase 11 and the cylinder block 21. The lower crankcase 11B, the upper crankcase 11A, the cylinder block 21 and the cylinder head 22 are connected by each stud bolt on both sides of the cylinders C1 to C4 arranged in a line. In FIG. 7, stud bolt insertion holes 79 are shown on the top face of the cylinder block 21. Stud bolt insertion bosses 80 surrounding each insertion hole 79 are provided to the cylinder block 21 and the crankcase 11. As shown in FIG. 7, the communicating hole 68 connected to the communicating passage 67 is arranged between adjacent stud bolt insertion bosses 80 on the front of the crankcase 11. As the communicating hole 68 is arranged avoiding the stud bolt insertion boss 80, the strength of the stud bolt insertion boss 80 can be prevented from being deteriorated by the communicating hole 68.

The internal combustion engine 1 is a parallel four-cylinder internal combustion engine, the exhaust pipes 46 coupled to the individual exhaust port 29 extend rearwardly on the downside of the internal combustion engine as shown in FIG. 1, are afterward united, and the united exhaust pipe is connected to the muffler 47 in the rear of the vehicle. The communicating passages 67 (FIG. 4) configured in a pair in a lateral direction of the internal combustion engine in the front view are provided at the back of the adjacent exhaust pipes 46. As described above, as the communicating passage 67 is covered with the plural exhaust pipes 46 in the front view, the communicating passage is protected by the exhaust pipes and is hardly striking from the outside owing to the exhaust pipes 46.

For a summary of the effects of the embodiment, the following effects are produced in this embodiment as described above in detail.

(1) As the opening of the drain for discharging oil into the drain is provided inside the communicating passage, the oil that enters the communicating passage can be discharged.

(2) As the drain is formed to discharge oil on the side of the oil pan provided to the crankcase, the entering oil can be recovered in the oil pan.

(3) As the communicating passage is configured by fixing the cover in the shape of a bowl that encloses the communicating hole provided to the crankcase so as to make the crank chamber and the communicating passage communicate to the crankcase and the bottom of the cover is inclined downward toward the opening of the drain, oil splashed inside the cover can be gathered into the opening of the drain and the efficiency of recovery can be enhanced.

(4) As the return passage of oil that lubricates the cylinder head and the valve system is connected to the communicating passage, the oil can be recovered in the oil pan together.

(6) As the opening of the drain is arranged near to the outside in the direction of vehicle width, oil which is apt to accumulate outside in the direction of vehicle width by centrifugal force can be efficiently recovered as the motorcycle is laterally banked.

(7) As the return oil inlet is set near to the inside in the direction of vehicle width off the opening of the drain in the direction of vehicle width, oil taken in from the inside is made to flow toward the opening of the drain outside the return oil inlet by centrifugal force and the oil can be prevented from accumulating.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-cylinder internal combustion engine wherein a communicating passage enables an internal space of a plurality of crank chambers corresponding to a plurality of cylinders to communicate, said communicating passage being provided to a crankcase, the multi-cylinder internal combustion engine comprising:

a drain; and an opening of the drain for discharging oil being provided inside the communicating passage;

wherein the oil is discharged from the opening of the drain via the drain, wherein the communicating passage is configured by fixing a cover in the shape of a bowl that encloses a communicating hole provided to the crankcase so as to make the crank chamber and the communicating passage communicate to the crankcase;

the bottom of the cover is inclined downward toward the opening of the drain; and a return passage of the oil that lubricates a cylinder head and a valve system is connected to the communicating passage.

2. The multi-cylinder internal combustion engine according to claim 1, wherein the drain is formed to discharge oil on the side of an oil pan provided to the crankcase.

3. The multi-cylinder internal combustion engine according to claim 2, wherein the multi-cylinder internal combustion engine is a parallel engine mounted in a motorcycle with its crankshaft located in a direction of vehicle width; and the opening of the drain is arranged near to the outside in the direction of vehicle width.

4. The multi-cylinder internal combustion engine according to claim 1, wherein the multi-cylinder internal combustion engine is a parallel engine mounted in a motorcycle with its crankshaft located in a direction of vehicle width; and the opening of the drain is arranged near to the outside in the direction of vehicle width.

5. The multi-cylinder internal combustion engine according to claim 4, wherein an inlet via which return oil via the oil return passage enters the communicating passage is set near to the inside in the direction of vehicle width off the opening of the drain in the direction of vehicle width.

6. A multi-cylinder internal combustion engine comprising:

a plurality of crank chambers corresponding to a plurality of cylinders;

a communicating passage formed for enabling communication between the plurality of crank chambers of the multi-cylinder internal combustion engine;

a drain; and an opening operatively connected to the drain for discharging oil being provided inside the communicating passage;

wherein the oil is discharged from the opening operatively connected to the drain via the drain to an oil pan, wherein the communicating passage is configured by fixing a cover in the shape of a bowl that encloses a communicating hole provided to the crankcase so as to make the crank chamber and the communicating passage communicate to the crankcase;

the bottom of the cover is inclined downward toward the opening of the drain; and a return passage of the oil that lubricates a cylinder head and a valve system is connected to the communicating passage.

7. The multi-cylinder internal combustion engine according to claim 6, wherein the drain is formed to discharge oil on the side of the oil pan provided to the crankcase.

8. The multi-cylinder internal combustion engine according to claim 6, wherein the multi-cylinder internal combustion engine is a parallel engine mounted in a motorcycle with its crankshaft located in a direction of vehicle width; and the opening of the drain is arranged near to the outside in the direction of vehicle width.

9. The multi-cylinder internal combustion engine according to claim 7, wherein the multi-cylinder internal combustion engine is a parallel engine mounted in a motorcycle with its crankshaft located in a direction of vehicle width; and the opening of the drain is arranged near to the outside in the direction of vehicle width.

10. The multi-cylinder internal combustion engine according to claim 8, wherein an inlet via which return oil via the oil return passage enters the communicating passage is set near to the inside in the direction of vehicle width off the opening of the drain in the direction of vehicle width.

* * * * *